US009339154B2

(12) United States Patent
Rudnick

(10) Patent No.: US 9,339,154 B2
(45) Date of Patent: May 17, 2016

(54) SYSTEM AND APPARATUS FOR REMOVAL OF TOILET PAPER AXLE

(71) Applicant: Donald Rudnick, Brooklyn, NY (US)

(72) Inventor: Donald Rudnick, Brooklyn, NY (US)

( * ) Notice: Subject to any disclaimer, the term of this patent is extended or adjusted under 35 U.S.C. 154(b) by 0 days.

(21) Appl. No.: 14/937,016

(22) Filed: Nov. 10, 2015

(65) Prior Publication Data

US 2016/0058251 A1 Mar. 3, 2016

Related U.S. Application Data

(63) Continuation-in-part of application No. 14/327,829, filed on Jul. 10, 2014, now abandoned.

(51) Int. Cl.
*B65H 16/06* (2006.01)
*A47K 10/40* (2006.01)

(52) U.S. Cl.
CPC ..... *A47K 10/40* (2013.01)

(58) Field of Classification Search
CPC ..... A47K 10/32; A47K 10/38; A47K 10/40; B65H 16/06; B65H 75/02; B65H 75/18; F16N 11/04; F16N 11/08; F16N 13/10; F16N 7/00
USPC ..... 242/598, 598.3, 599, 599.1; 184/37, 41, 184/47, 45.1, 45.2
See application file for complete search history.

(56) References Cited

U.S. PATENT DOCUMENTS

| | | | | | |
|---|---|---|---|---|---|
| 1,045,311 | A * | 11/1912 | Moberg | A47K 10/40 | 242/599.1 |
| 2,253,664 | A | 8/1941 | Vigo | | |
| 2,313,776 | A | 3/1943 | Segal | | |
| 2,434,556 | A | 1/1948 | Foltis | | |
| 2,449,598 | A | 9/1948 | Foltis | | |
| 3,037,718 | A | 6/1962 | Pettit | | |
| 3,239,158 | A | 3/1966 | Levesque | | |
| 3,280,539 | A * | 10/1966 | Parrott | B01D 46/18 | 242/599.1 |
| 3,362,653 | A * | 1/1968 | Carlisle | A47K 10/32 | 242/599.1 |
| D296,963 | S | 8/1988 | Smallwood | | |
| D405,305 | S | 2/1999 | Hobgood | | |
| D427,828 | S | 7/2000 | Senecal, Jr. | | |
| 6,422,505 | B1 | 7/2002 | Froesel | | |
| 6,431,493 | B1 | 8/2002 | Stauner | | |
| 6,688,551 | B1 * | 2/2004 | He | A47K 10/40 | 239/52 |
| 7,213,783 | B1 | 5/2007 | Schmatz | | |
| 7,357,350 | B1 | 4/2008 | Rogers | | |
| 2001/0052559 | A1 | 12/2001 | Inana et al. | | |
| 2004/0144883 | A1 | 7/2004 | Adler | | |

* cited by examiner

*Primary Examiner* — William A Rivera
(74) *Attorney, Agent, or Firm* — Larson & Larson, P.A.; Frank Liebenow; Patrick Reid

(57) ABSTRACT

A compressible axle has first portion that telescopically interfaces within a cavity of a second portion. An end of the first portion has a well containing a lubricant with a side wall having orifice(s) for emitting lubricant and an open end sealed by a movable plunger. A compression spring within the cavity urges the first portion away from the second portion such that a closing force applied to compress the first portion further into the cavity compresses the compression spring and thereby applying force onto the plunger and expelling a portion of the lubricant at an area where the first portion telescopically interfaces with the cavity in the second portion. Nubs at ends of the compressible axle are sized and shaped to fit within corresponding depressions of the depressions in the frame.

20 Claims, 4 Drawing Sheets

SYSTEM AND APPARATUS FOR REMOVAL OF TOILET PAPER AXLE

CROSS-REFERENCE TO RELATED APPLICATION

This application is a continuation in part of U.S. patent application Ser. No. 14/327,829, filed Jul. 10, 2014, the disclosure of which is hereby incorporated by reference.

FIELD

This invention relates to the field of hubs and more particularly to a system for simplified removal of toilet paper axles.

BACKGROUND

There are many existing designs for toilet paper holders. Common designs include a hinged arm mounted horizontally on a wall, a thick axle either recessed into a wall or mounted on a frame, a vertical pole on a base, etc. Often, the axle designs include an axle suspended between two members, such as frame members. The axle is somewhat free to spin and the roll of toilet paper is free to spin around the axle, permitting dispensing of the toilet paper by pulling on the first, exposed sheet of toilet paper.

In these toilet paper holders having axel designs, there typically is a mechanism to release the axle from the toilet paper holder frame. This facilitates removal of the disposable toilet paper roll core (cardboard tube) from a spent toilet paper role and enables replacement of the disposable toilet paper roll core with a new roll of toilet paper. After the new roll of toilet paper is placed on the axle, the axle is then re-engaged into the toilet paper holder frame.

Many such release mechanisms include a compressible axle having end nubs that fit within depressions in the toilet paper holder frame. To remove the compressible axle, force is exerted inwardly from one end of the compressible axle, or both ends, shortening the compressible axle sufficiently as to clear one or both of the depressions, thereby releasing the compressible axle from the depressions. Unfortunately, it is often difficult for many to compress the compressible axle, especially for those individuals having reduced dexterity. The ends of the compressible axle are often held very close to the toilet paper holder frame, making it difficult for the average person to position a finger between and end of the compressible axle and the wall of the toilet paper holder frame. This is further inhibited by the cardboard, toilet paper roll core, which remains on the compressible axle after the toilet paper is spent, making it even more difficult to reach in and compress the compressible axle. People with reduced dexterity, for example, those with arthritis, often have extreme difficulty changing toilet paper rolls.

What is needed is a system that will facilitate removal of the compressible axle for improved ease of changing toilet paper rolls.

SUMMARY

In one embodiment, a compressible axle for installing between two depressions in a frame of a toilet paper holder is disclosed. The compressible axle has a first portion that telescopically interfaces with a cavity in a second portion. A first end of the first portion has a nub and a first end of the second portion also has a nub. A second end of the first portion has a well containing a lubricant. The well is sealed by a plunger except for at least one orifice formed through a side of the well. A compression spring is positioned within the cavity between an inside surface of the cavity and the plunger. The compression spring urges the first portion away from the second portion such that a closing force applied to compress the first portion further into the cavity compresses the compression spring and applies force to the plunger, thereby expelling a portion of the lubricant from the at least one orifice to lubricate an area where the first portion telescopically interfaces with the cavity in the second portion. The nubs are sized and shaped to fit within corresponding depressions of the depressions in the frame.

In another embodiment, a compressible axle for installing between two depressions in a frame of a toilet paper holder is disclosed. A first portion of the compressible axle telescopically interfaces within a cavity in a second portion and a first end of the first portion has a nub. A second end of the first portion has a well containing a lubricant. A side wall of the well has at least one orifice for emitting the lubricant and an open end of the well is sealed by a movable plunger. A first end of the second portion also has a nub. A compression spring is within the cavity between an inside surface of the cavity towards the first end of the second portion and the plunger. The compression spring urges the first portion away from the second portion such that a closing force applied to compress the first portion further into the cavity compresses the compression spring and thereby the compression spring applies force onto the plunger, thereby expelling a portion of the lubricant from the at least one orifice to lubricate an area where the first portion telescopically interfaces with the cavity in the second portion. The nubs are sized and shaped to fit within corresponding depressions of the depressions in the frame.

In another embodiment, compressible axle for installing between two depressions in a frame is disclosed. A first portion of the compressible axle telescopically interfaces within a cavity in a second portion. A first end of the first portion has a and a second end of the first portion has a device for automatically emitting a lubricant into an interface where the first portion telescopically interfaces within the cavity in the second portion. The first end of the second portion also has a nub. A device such as a spring urges the first portion away from the second portion is within the cavity between an inside surface of the cavity towards the first end of the second portion and the device for lubricating. This device (e.g., a spring) pushes the first portion away from the second portion such that a closing force applied to compress the first portion further into the cavity compresses the device (e.g., spring) and thereby applies force onto the device for lubricating, thereby expelling a portion of a lubricant from the device for lubricating to lubricate an area where the first portion telescopically interfaces with the cavity of the second portion. The nubs are sized and shaped to fit within corresponding depressions of the depressions in the frame.

BRIEF DESCRIPTION OF THE DRAWINGS

The invention can be best understood by those having ordinary skill in the art by reference to the following detailed description when considered in conjunction with the accompanying drawings in which.

DETAILED DESCRIPTION

Figure 1:
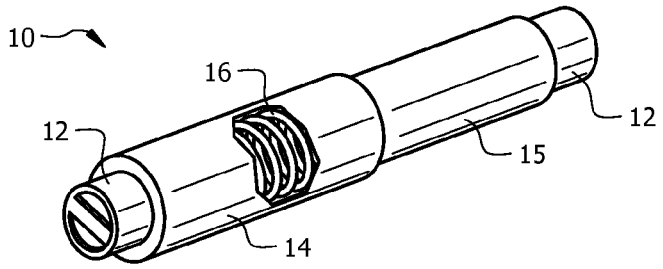
FIG. 1 (Prior Art)
FIG. 1 illustrates a perspective view of a compressible axle of the prior art.

Reference will now be made in detail to the presently preferred embodiments of the invention, examples of which are illustrated in the accompanying drawings. Throughout the following detailed description, the same reference numerals refer to the same elements in all figures.

Referring to FIG. 1, a perspective view of a compressible axle 10 of the prior art is shown. Although there are many known types of compressible axles 10, the typical compressible axle 10 includes two generally cylindrical tubes, a first end of one tube 15 sliding/telescoping into a first end of the second tube 14 and having a spring 16 within the second tube 14, urging the first tube 15 away from the second tube 14. Often, the opposite ends of each of the tubes 14/15 have nubs 12 that have reduced diameters that fit within depressions 3 in the toilet paper holder frame 5 (see FIG. 2).

Although shown using a spring 16 to urge apart the sections 14/15 of the compressible axle 10, there is no limitation or requirement that the compressible axle 10 include a spring 16, and any known or future compressible axle 10 is anticipated.

When the compressible axle 10 is secured within the depressions 3 of a toilet paper holder frame 5 (see FIG. 2), removal of the compressible axle 10 is facilitated by exerting a force inwardly from one end of the compressible axle 10 or simultaneously from both ends, shortening the compressible axle 10 sufficiently as to clear one or both of the depressions 3, thereby releasing the compressible axle 10 from the toilet paper holder frame 5. This is often accomplished by positioning of a finger between an end of the compressible axle and the frame 5 of the toilet paper holder frame 5, but this operation is often inhibited by the cardboard toilet paper roll core (not shown for clarity reasons, see FIG. 6 for example), which remains on the compressible axle 10 after the toilet paper is spent. The cardboard toilet paper roll core makes it difficult to reach the ends of the compressible axle 10 and, therefore, difficult to compress the compressible axle 10.

Figure 2:
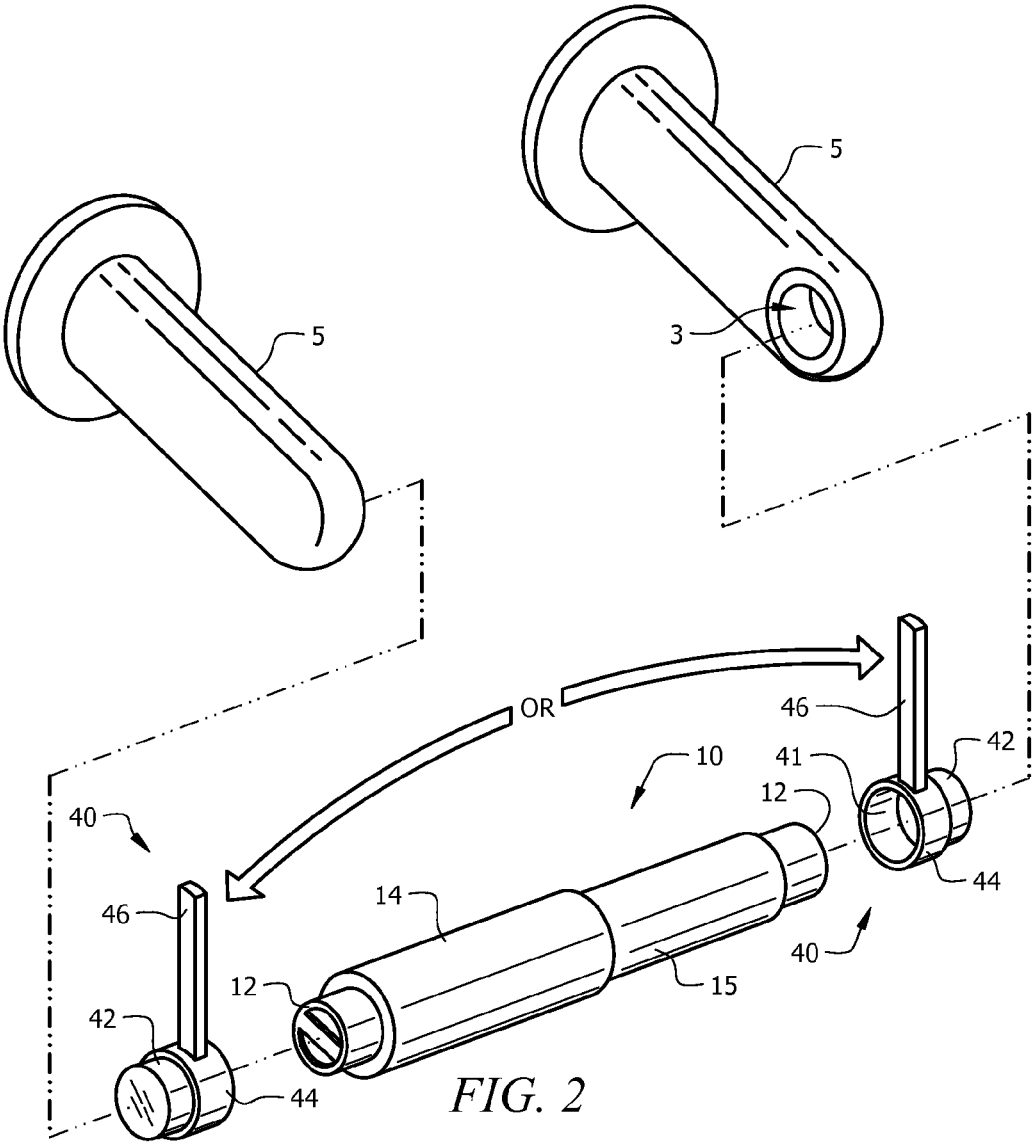
FIG. 2 illustrates a perspective view of a compressible axle with a pull-tab, ready for insertion into a toilet paper holder frame.

Referring to FIG. 2, a perspective view of a compressible axle 10 with a pull-tab assembly 40, ready for insertion into a toilet paper holder frame 5 is shown. The compressible axle 10 is similar to that previously described, but it is to be noted that, although a specific compressible axle 10 is shown, any type and shape of compressible axle 10 is anticipated, as well as any type and shape of corresponding toilet paper holder frame 5.

To alleviate the issues of such toilet paper holders as noted above, a pull-tab assembly 40 is added to one end, the other end, or both ends of the compressible axle 10. A base 44 of the pull-tab assembly 40 has a receiving portion 41 for receiving the nub 12 of the end of the compressible axle 10, a pull-tab nub 42 that fits within the depression 3 of the toilet paper holder frame 5, and a pull-tab 46 that extends far enough from the pull-tab assembly 40 to enable griping of the pull-tab 46 after the toilet paper is spent. In operation, to remove the compressible axle 10 from the depressions 3 in the toilet paper frame 5, force is placed on the pull-tab 46 in a direction toward the opposite side of the compressible axle 10, thereby compressing the compressible axle 10 and enabling the removal of the pull-tab nub 42 from the depression 3. It is anticipated that the pull-tab 46 be made of any suitable material, either a stiff material or a flexible material, including, but not limited to, the same material that the pull-tab base 44.

The inner diameter of the receiving portion 41 is slightly larger than the outer diameter of the nub 12 of the compressible axle 10, providing a compact and tight fit around the nub 12. The outer diameter of the pull-tab nub 42 is preferably substantially the same as the outer diameter of the nub 12 of the compressible axle 10, though any diameter is anticipated as long as the outer diameter of the pull-tab nub 42 is less than the inner diameter of the depression 3 of the toilet paper frame 5. By making the outer diameter of the pull-tab nub 42 be less than the inner diameter of the depression 3 of the toilet paper frame 5, the compressible axle 10 freely rotates within the depression 3 of the toilet paper frame 5.

In some embodiments, the pull tab 40 is integrated or manufactured as part of the compressible axle 10, while in other embodiments; the pull tab 40 is manufactured as an independent component for later affixing to the nub 12 of a compressible axle 10.

Figure 3:
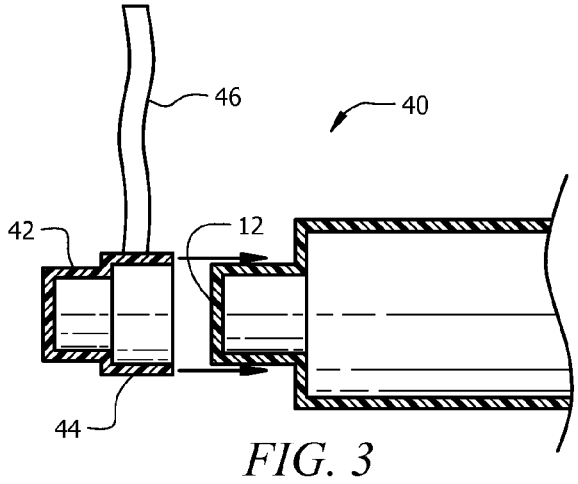
FIG. 3 illustrates a sectional view of a compressible axle with a first add-on pull-tab.
Figure 4:
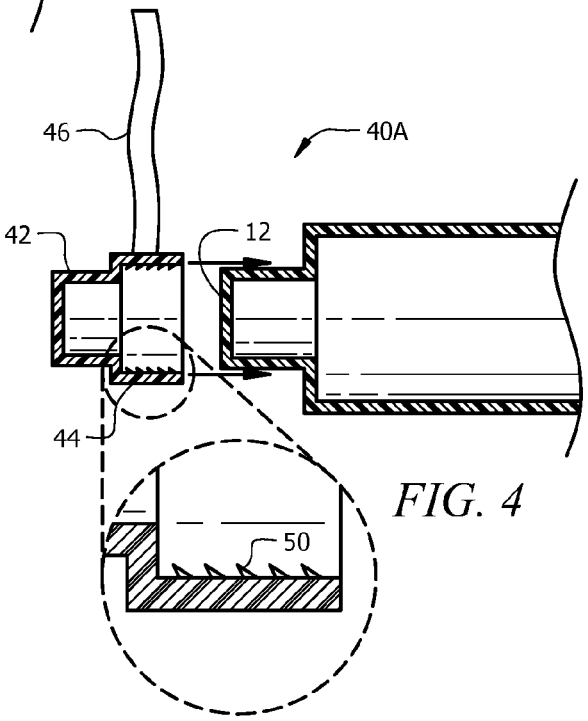
FIG. 4 illustrates a sectional view of a compressible axle with a second add-on pull-tab.
Figure 5:
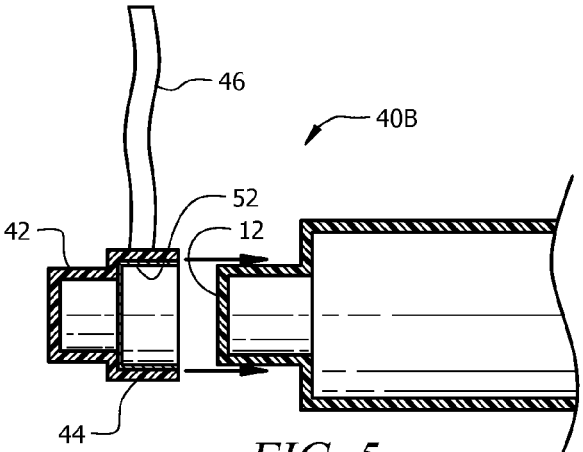
FIG. 5 illustrates a sectional view of a compressible axle with a third add-on pull-tab.

Referring to FIGS. 3, 4, and 5, sectional views of a compressible axle 10 with add-on pull-tabs 40/40A/40B are shown. Although it is anticipated that the pull-tab assembly 40 be integrated into the compressible axle 10, in some embodiments, the pull-tab assembly 40 is a separate component 40/40A/40B that is added to existing compressible axles 10.

In FIG. 3, the pull-tab assembly 40 is shown with a compression fit, being pushed onto the nub 12 of a compressible axle 10. In this embodiment, the inner diameter of the receiving portion 41 is very close to the outer diameter of the nub 12, thereby creating a press-fit.

In FIG. 4, the pull-tab assembly 40A with a toothed retaining mechanism is shown being pushed onto the nub 12 of a compressible axle 10. In this embodiment, the inner diameter of the receiving portion 41 has inwardly pointed teeth 50. Once pushed onto to the outer diameter of the nub 12, the teeth 50 dig into the nub 12 and hold the pull-tab assembly 40A onto the nub 12.

In FIG. 5, the pull-tab assembly 40B is shown with an adhesive 52, being pushed onto the nub 12 of a compressible axle 10. In this embodiment, the inner diameter of the receiving portion 41 is held to the outer diameter of the nub 12 by an adhesive 52.

Figure 6:
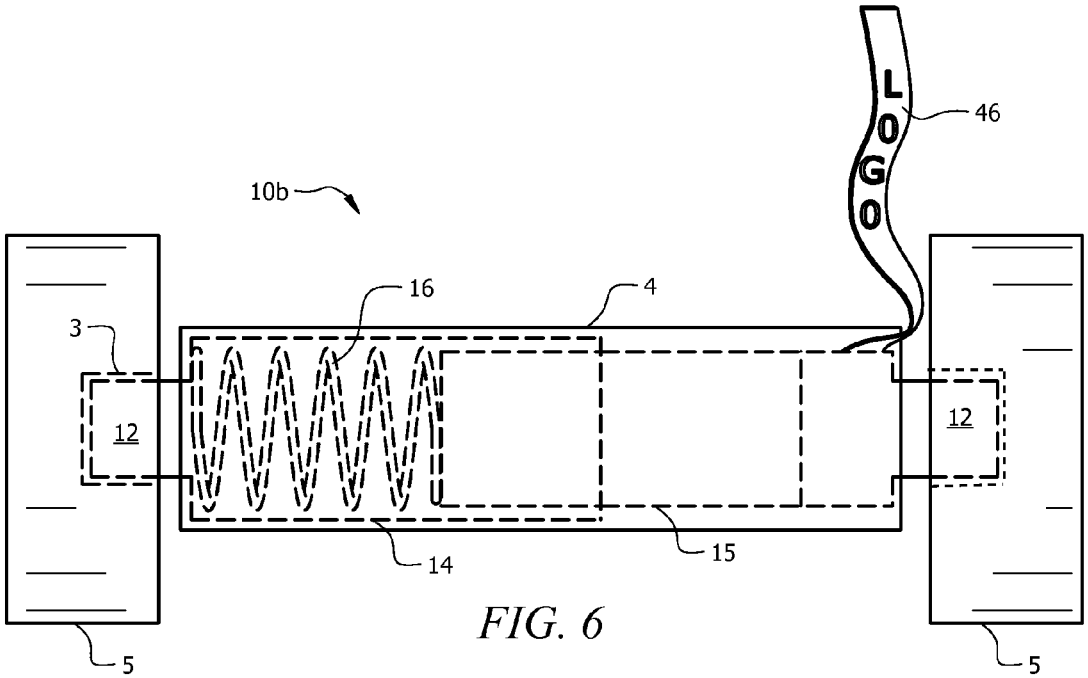
FIG. 6 illustrates a side view of a modified compressible axle inserted into a toilet paper holder frame, partially hidden by the core of a toilet paper roll.

Referring to FIG. 6, a cut-away view of a modified compressible axle 10B inserted into a toilet paper holder frame 5 is shown. In this example, the pull-tab assembly is manufactured/formed as part of the compressible axle 10*b*. Most of the compressible axle 10*b* is similar to a standard compressible axle 10 as previously described, having a nub 12 (shown fit within a depression 3 of the toilet paper holder 5), a first, slightly larger tube 14, a compression spring 16 and a slightly smaller tube 15 that telescopes within the slightly larger tube 14, biased outwardly by the spring 16. In this example, a pull-tab 46 is affixed to an end of the smaller tube 15, extending around the toilet paper roll core 4 to facilitate removal of the toilet paper roll core 4 after the toilet paper (not shown for clarity reasons) is spent.

Figure 7:
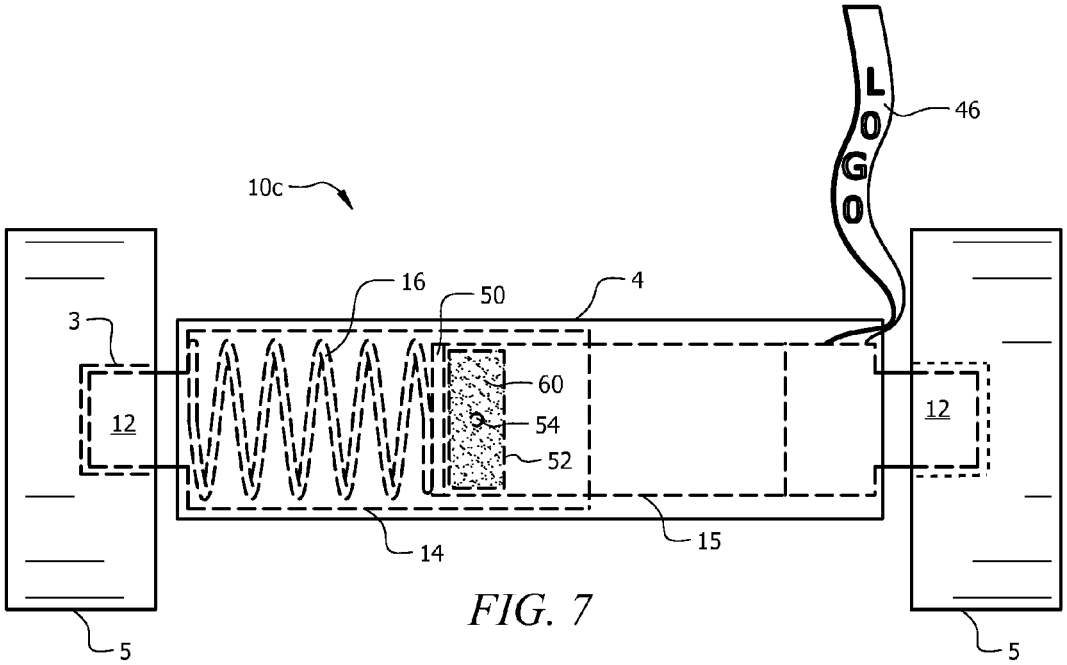
FIG. 7 illustrates a side view of an alternate, modified compressible axle inserted into a toilet paper holder frame, partially hidden by the core of a toilet paper roll.
Figure 8:
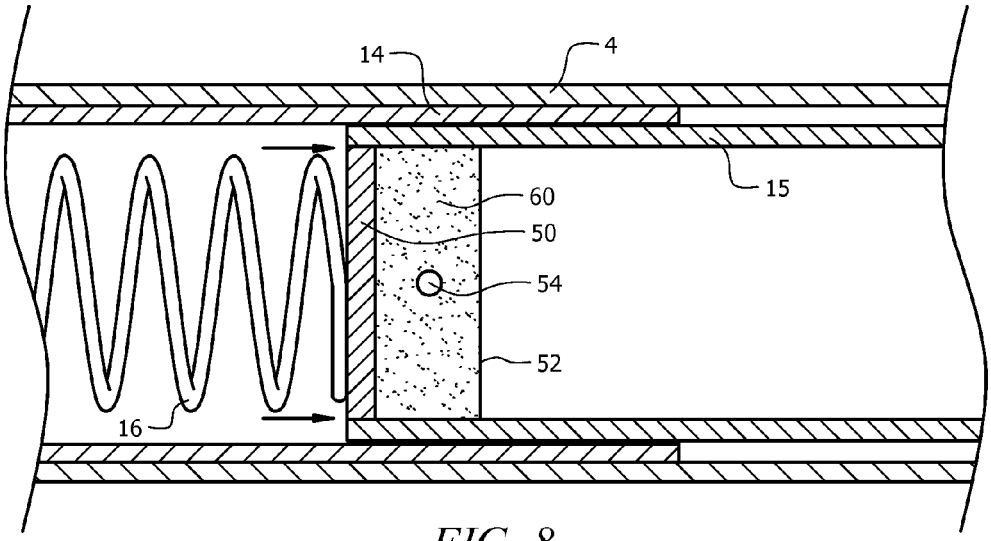
FIG. 8 illustrates a detailed side view of the alternate, modified compressible axle inserted into a toilet paper holder frame, partially hidden by the core of a toilet paper roll.

Referring to FIGS. 7 and 8, views of the alternate, modified compressible axle 10*c* inserted into a toilet paper holder frame 5 are shown. As discussed prior, many individuals with various ailments such as arthritis find it difficult to remove the spent toilet paper roll 4 from the toilet paper frame 5. There are at least two issues addressed by the alternate, modified compressible axle 10*c*; helping such individuals compress and remove the spent toilet paper roll 4 from the toilet paper frame 5 by use of a pull-tab 46, and periodically lubricating the interface between the two sections 14/15 of the telescoping compressible axle 10*c*.

In such, a pull-tab 46 is manufactured/formed as part of the compressible axle 10*c*. The compressible axle 10*c* has a nub 12 (shown within a depression 3 of the toilet paper holder 5), a first, slightly larger tube 14, a compression spring 16, and a slightly smaller tube 15 that telescopes within the slightly larger tube 14. The telescoping tubes 14/15 are biased outwardly by the spring 16. In this example, the pull-tab 46 is affixed to an end of the smaller tube 15, extending out from beneath the toilet paper roll core 4. The pull-tab 46 facilitates removal of the toilet paper roll core 4 after the toilet paper (not shown for clarity reasons) is spent. In use, after the toilet paper is spent, the user pulls the pull-tab 46 overcoming some of the force of the spring 16, forcing the slightly smaller tube 15 to telescope slightly within the slightly larger tube 14.

Being that the telescoping tubes 14/15 are typically made by various manufacturing practices from plastic at various tolerances, there is often varying amounts of friction between the telescoping tubes 14/15 that is often dependent upon temperature, humidity, dust, etc. Therefore, at times, the resistance makes it difficult to compress the telescoping tubes 14/15, especially by those with reduced dexterity. To reduce friction and improve sliding movement between the telescoping tubes 14/15, the alternate, modified compressible axle 10*c* includes an automatic lubrication dispensing mechanism 50/52/54/60. The lubrication dispensing mechanism 50/52/54/60 includes a well 52 formed at an inner end of the smaller tube 15 (opposite end from the nub). The well 52 contains a lubricant 60 (e.g., petroleum jelly, dielectric silicon grease, silicon grease, etc.). The well 52 is capped by a plunger 50 (e.g., a flat disc) that snuggly fits within a diameter of the well 52, reducing leakage of the lubricant 60 from the interface between the plunger 50 and the well 52. The plunger 50 is positioned between the spring 16 and the lubricant 60. There are one or more orifices 54 on the sides of the well 52, preferably close to the inner end of the smaller tube 15. Basically, the well 52 is sealed by the plunger 50 except for the one or more orifices 54.

When the compressible axle 10*c* is expanded, either when removed from the toilet paper holder 5 or after expanding within the depressions 3 of the toilet paper holder 5, tension on the spring 16 is relaxed and, consequently, little or no force is exerted by the spring 16 onto the plunger 50, resulting in little or no lubricant 60 escaping from the orifice(s) 54. Each time the compressible axle 10*c* is compressed (e.g. during removal from and insertion into the toilet paper holder 5), the spring 16 exerts pressure on the plunger 50, thereby expelling a small amount of lubricant 60 from the orifice(s) 54, thereby reducing the resistance between the telescoping tubes 14/15 and making it easier for those with limited dexterity to remove and replace the toilet paper roll 4.

Note that, in some embodiments, the pull-tab 46 is provided. In some such embodiments, the pull-tab 46 includes advertisements such as the manufacturer or advertisements for a particular brand of toilet paper, etc.

Note also that, although toilet paper holders are used in the above descriptions, the disclosed compressible axles are also anticipated in other household uses such as paper towel holders, etc.

Equivalent elements can be substituted for the ones set forth above such that they perform in substantially the same manner in substantially the same way for achieving substantially the same result.

It is believed that the system and method as described and many of its attendant advantages will be understood by the foregoing description. It is also believed that it will be apparent that various changes may be made in the form, construction and arrangement of the components thereof without departing from the scope and spirit of the invention or without sacrificing all of its material advantages. The form herein before described being merely exemplary and explanatory embodiment thereof. It is the intention of the following claims to encompass and include such changes.

What is claimed is:

1. A compressible axle for installing between two depressions in a frame, the compressible axle comprising:

a first portion that telescopically interfaces with a cavity in a second portion; a first end of the first portion has a first nub and a first end of the second portion has a second nub; a second end of the first portion has a well containing a lubricant, the well is sealed by a plunger except for at least one orifice through a side of the well; and a compression spring is positioned within the cavity between an inside surface of the cavity and the plunger; the compression spring urges the first portion away from the second portion such that a closing force applied to compress the first portion further into the cavity compresses the compression spring and applies force to the plunger, thereby expelling a portion of the lubricant from the at least one orifice to lubricate an area where the first portion telescopically interfaces with the cavity in the second portion;

wherein the first nub and the second nub are sized and shaped to fit within corresponding depressions of the depressions in the frame.

2. The compressible axle of claim 1, further comprising a pull-tab affixed to either the first end of the first portion or to the first end of the second portion.

3. The compressible axle of claim 2, wherein the pull-tab includes advertising.

4. The compressible axle of claim 1, wherein the lubricant is petroleum jelly.

5. The compressible axle of claim 1, wherein the lubricant is silicon grease.

6. The compressible axle of claim 1, wherein the lubricant is dielectric silicon grease.

7. A compressible axle for installing between two depressions in a frame of a toilet paper holder, the compressible axle comprising:

a first portion that telescopically interfaces within a cavity in a second portion, a first end of the first portion has a first nub, a second end of the first portion has a well containing a lubricant, a side wall of the well has at least one orifice for emitting the lubricant, an open end of the well is sealed by a movable plunger, a first end of the second portion has a second nub; and a compression spring is within the cavity between an inside surface of the cavity towards the first end of the second portion and the plunger; the compression spring urges the first portion away from the second portion such that a closing force applied to compress the first portion further into the cavity compresses the compression spring and thereby the compression spring applies force onto the plunger, thereby expelling a portion of the lubricant from the at least one orifice to lubricate an area where the first portion telescopically interfaces with the cavity in the second portion;

wherein the first nub and the second nub are sized and shaped to fit within corresponding depressions of the depressions in the frame.

8. The compressible axle of claim 7, further comprising a pull-tab affixed to either the first end of the first portion or to the first end of the second portion.

9. The compressible axle of claim 8, wherein the pull-tab includes advertising.

10. The compressible axle of claim 7, wherein the lubricant is petroleum jelly.

11. The compressible axle of claim 7, wherein the lubricant is silicon grease.

12. The compressible axle of claim 7, wherein the lubricant is dielectric silicon grease.

13. A compressible axle for installing between two depressions in a frame, the compressible axle comprising:

a first portion that telescopically interfaces within a cavity in a second portion, a first end of the first portion has a first nub, a second end of the first portion has means for lubricating an interface where the first portion telescopically interfaces within the cavity in the second portion, a first end of the second portion has a second nub; and means for urging the first portion away from the second portion is within the cavity between an inside surface of the cavity towards the first end of the second portion and the plunger; the means for urging pushes the first portion away from the second portion such that a closing force applied to compress the first portion further into the cavity compresses the means for urging and thereby applies force onto the means for lubricating, thereby expelling a portion of a lubricant from the means for lubricating to lubricate an area where the first portion telescopically interfaces with the cavity of the second portion;

wherein the first nub and the second nub are sized and shaped to fit within corresponding depressions of the depressions in the frame.

14. The compressible axle of claim 13, further comprising a pull-tab affixed to either the first end of the first portion or to the first end of the second portion.

15. The compressible axle of claim 14, wherein the pull-tab includes advertising.

16. The compressible axle of claim 13, wherein the means for lubricating emits a lubricant upon receiving pressure from the means for urging.

17. The compressible axle of claim 16, wherein the lubricant is petroleum jelly.

18. The compressible axle of claim 16, wherein the lubricant is silicon grease.

19. The compressible axle of claim 16, wherein the lubricant is dielectric silicon grease.

20. The compressible axle of claim 13, wherein the means for lubricating comprises:

a well containing a lubricant, a side wall of the well has at least one orifice for emitting the lubricant, and an open end of the well is sealed by a movable plunger, the movable plunger is operatively interfaced to the means for urging.

* * * * *